United States Patent [19]

Coles et al.

[11] Patent Number: 4,610,351

[45] Date of Patent: Sep. 9, 1986

[54] INSULATED DRINKING CUPS

[75] Inventors: Robert E. Coles; Alec T. Newman, both of Warwicks, Great Britain

[73] Assignee: General Foods Ltd., Banbury, United Kingdom

[21] Appl. No.: 200,818

[22] Filed: Oct. 27, 1980

Related U.S. Application Data

[63] Continuation-in-part of Ser. No. 42,389, May 25, 1979, abandoned.

[51] Int. Cl.[4] ..... B65D 21/02; B65D 62/00; B65D 85/72

[52] U.S. Cl. ..... 206/217; 206/519; 206/520; 220/74; 229/1.5 B

[58] Field of Search ..... 206/217, 519, 520; 229/1.5 B; 220/74

[56] References Cited

U.S. PATENT DOCUMENTS

| | | | |
|---|---|---|---|
| 3,237,803 | 3/1966 | Edwards | 206/520 |
| 3,375,954 | 4/1968 | Honkanen | 206/520 |
| 3,512,677 | 5/1970 | Kovacs | 206/520 |
| 3,721,367 | 3/1973 | Fletcher | 206/519 |

FOREIGN PATENT DOCUMENTS

| | | | |
|---|---|---|---|
| 705397 | 3/1968 | Belgium . | |
| 2063202 | 6/1971 | France | 206/519 |

*Primary Examiner*—George E. Lowrance
*Attorney, Agent, or Firm*—Joyce P. Hill; Linn I. Grim; Daniel J. Donovan

[57] ABSTRACT

A nestable vending-type cup of thermoplastic material comprised of a base having an integral peripheral upstanding wall which together with the base forms a liquid reservoir. The free end of the wall is turned over to form an outwardly and downwardly extending collar which extends circumjacent the upper part of the upwardly extending portion of the wall and is spaced therefrom. The collar is so constructed that when gripped by a user, it remains spaced from the upwardly extending portion of the wall. The collar is provided with strengthening features consisting of an outwardly and downwardly inclined shoulder and indents defined with vertical walls lying in radial planes to increase the rigidity of the collar. The construction of the cup provides a cup which is comfortably and easily held by the user when it contains hot beverages and which is also economic to manufacture.

5 Claims, 2 Drawing Figures

INSULATED DRINKING CUPS

DESCRIPTION

This application is a continuation-in-part of application Ser. No. 042,389, filed May 25, 1979, now abandoned.

TECHNICAL FIELD

The present invention relates to nestable vending cups, particularly those cups from which hot beverages such as coffee are drunk, and to a stack of such cups.

BACKGROUND ART

It has long been known that single-walled cups do not present a very good thermal barrier to insulate the fingers of a person holding such a cup containing a hot beverage from the heat given out by that beverage.

Better heat insulation is obtained by using a so-called "double-walled" cup which is, in fact, two cups, one being inside the other, joined at their rims and having an air space between the outer wall of the inner cup and the inner wall of the outer cup. This wall/air/wall barrier has proved effective in minimizing the amount of heat from a hot beverage inside the inner cup which will reach the fingers of a person holding the cup, thereby enabling the cup to be held without discomfort.

Such double-walled cups are, however, expensive to produce in that two single-walled cups have to be made and then joined together. Furthermore, a large part of the outer of the two cups is not always put to good use. A cup can readily be held in the fingers without the fingers going below half-way down the wall of the cup, and indeed it is possible, although difficult, to hold a cup without the fingers going below about 10 mm from the rim of the cup.

United Kingdom Patent Specification No. 1,379,371 describes an injection moulded cup which has a substantially cylindrical upper portion forming the mouth of the cup and lower portion tapering towards its bottom. A substantially cylindrical collar is connected to the transition between these two portions by means of a web. This arrangement allows the user to grip the cup by means of the collar and the provision of the air gap between the collar and the container wall means that heat is only transmitted to the user's fingers by conduction along the web.

The complicated nature of the shape of the cup shown in United Kingdom Pat. No. 1,379,371 makes it, however, difficult to manufacture and the only really feasible method of manufacture is by the expensive process of injection moulding. The vertical orientation of the collar means the collar and web construction has to have considerable rigidity, and therefore thickness, in order to prevent the collar deforming when gripped, to such an extent that the collar engages the wall of the cup. Further the design of the cup is such that a large amount of material is needed to form the cup.

Various other constructions have been developed for cups intended to provide heat insulation such as those described in U.S. Pat. No. 3,612,346, United Kingdom Pat. No. 1,325,230 and Belgian Pat. Nos. 703,364 and 705,397. Although these cups and those described above have been designed for providing thermal insulation by an air space between the wall of the cup in contact with the hot liquid and the cup gripping surface, their construction apparently requires considerable quantities of material (thickness) to insure wall rigidity for maintaining the essential air space when the cup, heavy with hot liquid, is tightly gripped by hand.

It will be appreciated that vending cups are disposable items and that relatively small difference in cost of a single item can make the difference between a cup being commercially usable or being a mere impractical concept.

DISCLOSURE OF INVENTION

The present invention provides a nestable cup which can be held by the user when it contains hot water or hot beverage and which is simple and economic to manufacture.

According to the present invention, there is provided a nestable vending cup formed of thermoplastics material comprising a base, a wall integral with and upstanding from the base to define therewith a liquid reservoir and a collar circumjacent the wall, the collar being attached to and spaced from the wall such that when the collar is gripped by the user it remains spaced from the wall.

The collar is formed of the same material as the wall of the cup and is of the same thin gage (economical thickness of material) as the cup wall. To insure rigidity when tightly gripped, the collar is extended outwardly from the wall of the cup and is provided with an outwardly extending and downwardly inclined shoulder at substantially the midpoint of its depending length; the provision of the shoulder increases the rigidity of the collar.

The collar is also formed to have a multiplicity of uniformly spaced fingertip-size indents about its periphery which, not only provide for secure gripping of the cup when it is heavy with hot liquid, but also increase the rigidity of the thinwalled collar. The uniformly spaced indents are formed with three of their four walls substantially normal to the circumferential surface of the collar to provide additional rigidity. Thus, the indents facilitate holding the cup at the collar with relatively non-tight gripping (which results in little or no collar inwardly flexing force) and also, in conjunction with the shoulder of the collar are constructed to have walls positioned to effectively restrain any radially inwardly (toward the cup wall) flexing of the collar which may be produced by gripping the collar and thus insuring maintenance of the thermal insulating air space between cup wall and outwardly depending collar.

The invention, therefore, consists in the features of construction which will be exemplified in the vending cup hereinafter described in detail and the scope of which will be indicated in the appended claims; it being understood that changes in the precise embodiments of the invention herein disclosed may be made within the scope of what is claimed without departing from the spirit of the invention.

BRIEF DESCRIPTION OF THE DRAWINGS

In the accompanying drawing wherein like reference characters indicate like parts in each figure.

BEST MODE FOR CARRYING OUT THE INVENTION

Figure 1:
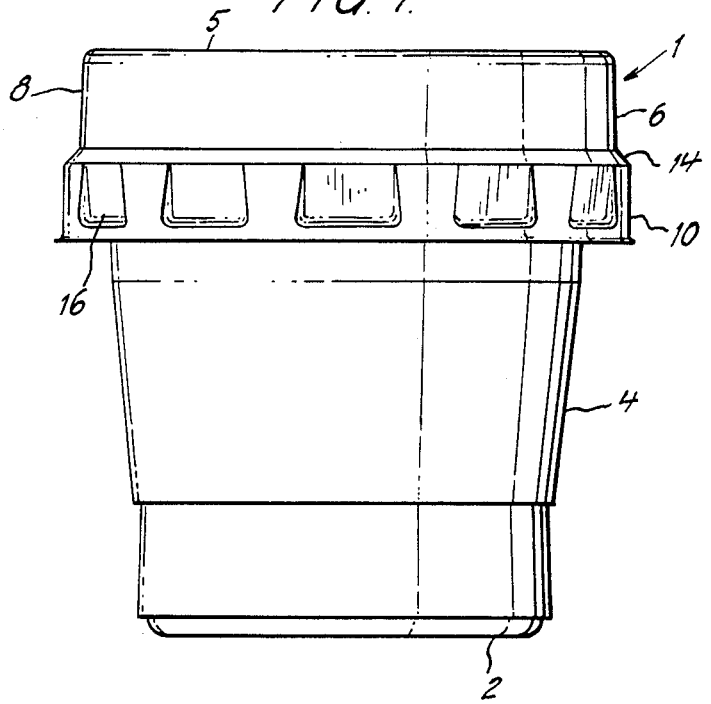
FIG. 1 is an elevational view of the vending cup in accordance with the invention.

Referring to FIG. 1, the vending cup (1) comprises a generally cylindrical base (2) with an upstanding integral wall (4) formed around its periphery. The free end of the wall is turned over to form a lip (5) and an outwardly and downwardly extending collar (6). The collar (6) has an upper portion (8) which extends downwardly and outwardly and a lower flared skirt portion (10). Interposed between the upper portion of the collar and the flared skirt position is a shoulder (14) which, as shown, extends outwardly and inclines downwardly. That is, both the upper and lower flared skirt portions of the collar diverge away from the upwardly extending portion of the wall (4) as does the interposed shoulder (14) to an even greater extent.

Uniformly spaced about the lower flared skirt portion of the collar are a number of fingertip-size indents (16). Each of the indents is shaped to have two substantially vertical side walls and one substantial horizontal bottom wall. These walls lie in planes normal to the cylindrical surface of the lower portion of the collar and thus, are positioned to enhance the rigidity of the collar when gripped by the hand.

Figure 2:
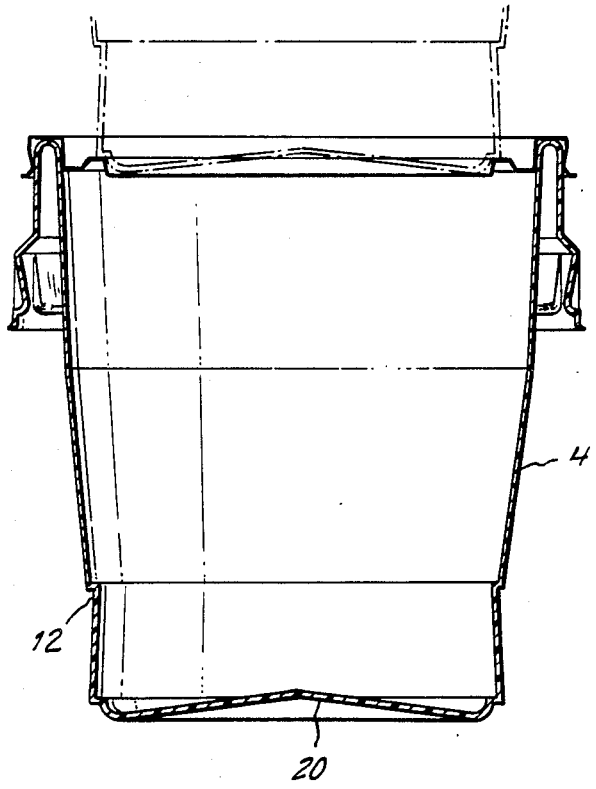
FIG. 2 is a vertical sectional view (taken at the diameter) of the cup of FIG. 1 and shows the placement of a tight fitting lid (not in section) over the lip of the cup. The figure also indicates (alternatively) in phantom, the positioning of a second cup for nesting cups together.

The vending cup of the invention is further provided with an inwardly extending annular internal shoulder (12) shown in FIG. 2 for supporting a like cup in a nesting relationship.

It will be noted that the flared portion (10) of the collar (6) allows the upper cup to be nested in the lower cup in such a way as to readily allow the lower cup to be withdrawn from the stack.

Also, as shown in FIG. 2 the cup base (2) has a central dome shaped portion (20) which is provided both to give strength to the cup and to resist inversion of the base which can occur when a hot liquid is poured into the cup.

In use a hot liquid is poured into the cup to make a beverage. The user can then grip the cup by means of the collar (6). The arrangement of the shape and rigidity of the collar is such that when the cup is gripped under normal pressures the collar remains spaced from the upwardly extending portion of the wall (4). The air within this space is a reasonably good heat insulator and thus to all intents and purposes heat is only conveyed from the hot beverage to the user's fingers by conduction of the heat from the liquid up the upwardly extending portion of the wall (4). through the lip (5) and down the collar (6).

It will be appreciated that the length of this path is considerably greater than the thickness of a normal thermoplastics cup and therefore the cup is considerably more comfortable to hold than a traditional thermoplastics cup.

The essential requirement for the collar (6) is that when it is gripped by a user it remains spaced from the upwardly extending portion of the wall (4). The collar should, in addition, not detract from the lip (5) mouth-contact contour. The collar typically extends about 20 to 30 mm from the cup lip. The drinking surface is not impaired if the upper portion (8) of the collar extends for at least 5 mm before the shoulder is provided.

It will be noted that in the construction the lip (5) offers an improved drinking surface over that of many of the prior art cups, in particular because there is no need when making the cup to roll the rim which is normally an additional operation in those cups which are manufactured by thermoforming. Thus, the thin walled collar of thermoplastics material is constructed to have the essential rigidity by (1) extending the collar outwardly (as well as downwardly); (2) including a shoulder at or near the midpoint of the collar; and (3) forming indents below the shoulder, each indent having 3 defining walls positioned to restrain inward radial flexing of the collar.

It should be noted the indents and shoulder also indirectly enhance the rigidity of the collar by providing surfaces which lessen the need to grip the cup tightly about the collar (less flexing force) in order to have a secure hold on it.

Additionally, the placement of the shoulder in the collar is not only optimum for collar stiffening purposes but induces the consumer to hold the cup with the fingers in contact with indents thereby not interfering with the lip surface for drinking and extending the heat conductive length of the collar (before finger contact) to assure comfortable use of the cup when containing a hot beverage.

When nested there is space for dry beverage ingredient, such as soluble coffee powder, in the bottom of each cup. Thus, before nesting, the cups can be partly filled with food powders of many kinds of beverages.

When these cups are stacked the top cup can be fitted with a plug or snap on cap to retain the beverage ingredient in the cup. Alternatively, a "dummy" cup which does not contain any ingredient may be useful. A plug is to be preferred to a snap-on cap when the stack is wrapped since the plug allows the enveloping film to be drawn into the top aperture region of the stack of cups and enables adequate top pressure to be obtained. Preferably the wrapped stack should be under a top to bottom pressure sufficient to prevent seepage of the beverage ingredients from the cups. Preferred methods of wrapping are described in United Kingdom Pat. No. 1,539,729.

Whilst any thermoplastics material may be used to form the cup, currently commercially suitable materials include polystyrene, acrylonitrile/butadiene/styrene, and polypropylene resins, optionally filled with, for example, talc or chalk for additional strength. The use of barrier resins or laminates/coextrusions is preferred since they improve the shelf life of beverage ingredients. Because of the relatively low softening point, polyvinyl chloride and some acrylonitrile/butadiene/styrenes cannot be used for cups for which very hot beverages are to be drunk, although they can be used in connection with warm beverages.

It will be appreciated that it is the unitary construction of the cup which facilitates easy construction by thermoforming techniques well known to those skilled in the art.

It will further be appreciated that alternatively the cup can be formed by injection moulding or injection blow moulding.

We claim:

1. A nestable vending-type cup formed of thin gauge thermoplastic material comprising a base (2) a wall (4) integral with and upstanding from the base (2) to define therewith a liquid reservoir, said wall (4) turned over at its free end to from a collar (6) circumjacent the wall (4), said collar (6) characterized by inclining outwardly and extending downwardly from the wall (4) of the cup for at least 5 mm before a shoulder (14) is provided, said shoulder extending outwardly at a 45° angle from the collar and interposed midway between an upper portion (8) of the collar and a lower flared skirt portion (10), and having a multiplicity of uniformly spaced indents (16) located before the shoulder and on the periphery of the flared skirt portion (10), each of said indents (16) designed to increase the transverse rigidity of the collar such that when the collar is gripped by the user it remains spaced from the upstanding wall (4).

2. The nestable vending-type cup of claim 1 wherein each of the indents (16) is partially defined having two defining vertical walls, each wall lying in a plane normal to the curved surface of the flared skirt portion (10) of the collar (6) with a lower horizontal wall.

3. The nestable vending-type of claim 1 cup characterised in that it further comprises an inwardly extending shoulder (12) on the wall (4) which shoulder (12) is capable of supporting a like cup (1), and defining with the base (2) of the like cup (1) a space for one or more powderous ingredients.

4. A cup as claimed in claims 1 or 2 characterised in that the size and shape of the collar (6) is such that when the cup (1) is nesting in said like cup (1), the collar (6) overlaps the collar (6) in said like cup (1).

5. A stack of cups as claimed in claim 3, each cup containing one or more powderous ingredients for a beverage.

* * * * *